US006048236A

United States Patent [19]

Natsume

[11] Patent Number: 6,048,236

[45] Date of Patent: Apr. 11, 2000

[54] LOWER UNIT FOR MARINE PROPULSION SYSTEM

[75] Inventor: Noriyuki Natsume, Hamamatsu, Japan

[73] Assignee: Sanshin Kogyo Kabushiki Kaisha, Japan

[21] Appl. No.: 09/150,784

[22] Filed: Sep. 10, 1998

[30] Foreign Application Priority Data

Sep. 15, 1997 [JP] Japan ..... 9-267786

[51] Int. Cl.[7] ..... B63H 1/18

[52] U.S. Cl. ..... 440/66; 440/76; 123/195 P

[58] Field of Search ..... 440/66, 71, 76–78; 123/195 P

[56] References Cited

U.S. PATENT DOCUMENTS 4,323,355 4/1982 Kondo ..... 440/76

*Primary Examiner*—Jesus D. Sotelo

*Attorney, Agent, or Firm*—Knobbe, Martens, Olson & Bear, LLP

[57] ABSTRACT

A marine outboard drive that is equipped with integrated splash plates and a baffle plate that prevent water splash-up along the drive shaft housing. The baffle plate protrudes from the drive shaft housing to interact with plates on the lower bracket to create a labyrinth effect. The labyrinth created by the splash and baffle plates impedes the path of any water impinging upon the lower bracket and the drive shaft housing. This minimizes the amount of water travelling up the drive shaft housing. A splash plate may also be included on the lower bracket to minimize water flow above the lower bracket.

12 Claims, 6 Drawing Sheets

LOWER UNIT FOR MARINE PROPULSION SYSTEM

BACKGROUND OF THE INVENTION

1. Field of the Invention

The present invention relates to a marine drive, and in particular to a splash and baffle plate used in conjunction with a marine drive.

2. Description of the Related Art

Many watercraft employ outboard motors that are mounted on the aft end of the watercraft. An outboard motor generally includes a power head that houses an engine, a drive shaft housing situated below the power head, and a lower unit that is positioned below the drive shaft housing. The lower unit typically houses a transmission and a propulsion shaft that drives a propulsion device, such as a propeller.

As the watercraft travels through the water, water impinges against the front of the lower unit and tends to splash upward between the transom of the boat and the outboard motor. It is generally undesirable for the water to splash into the watercraft or onto the mounting structure between the watercraft and the outboard drive. Hence, prior outboard motors conventionally employ one or more splash plates that are positioned above the anti-cavitation plate. The splash plates extend from the forward side of the drive shaft housing and serve to block water from splashing upwardly between the watercraft and the outboard motor.

However, on some watercraft, the outboard motor may be mounted so that the splash plate is submerged as the watercraft travels through the water. In these circumstances, water splashes unimpeded around the outboard motor and may splash between the watercraft and the outboard motor. Any water flowing between the steering shaft and the watercraft may ultimately enter the cowling assembly. Water may also flow between the steering shaft and the drive shaft housing and thereby enter the cowling assembly.

What is needed is a water exclusion system designed to prevent water from moving up the drive shaft housing toward the cowling assembly. The water exclusion system should function when the splash plates are either above or below the surface of the water. The water exclusion system should also decrease water flow both forward of the steering shaft and the drive shaft housing.

SUMMARY OF THE INVENTION

The present invention is a marine outboard drive that is equipped with integrated splash plates and a baffle plate that prevent water splash-up along the drive shaft housing. The baffle plate protrudes from the drive shaft housing to interact with plates on the lower bracket to create a labyrinth effect. The labyrinth created by the splash and baffle plates impedes the path of any water impinging upon the lower bracket and the drive shaft housing. This minimizes the amount of water travelling up the drive shaft housing.

The present invention also includes a splash plate integrally formed along the front and sides of the lower bracket holding the steering shaft. The splash plate deflects any water not deflected by the splash plates attached to the lower unit of the marine drive. This prevents water from splashing upward along the front and sides of the steering shaft, thereby preventing the water from entering the cowling assembly.

The present invention further includes a splash rib designed to deflect water passing beneath the lower bracket.

The splash rib decreases the size of the opening between the lower bracket and a level surface on the lower unit. By decreasing the size of this opening, less water passes through this opening to eventually reach the drive shaft housing.

One embodiment of the present invention is a water exclusion system for an outboard motor comprising a first plate and a baffle plate. The first plate extends from a lower bracket in a first direction partially into an opening between a lower bracket and a drive shaft housing and the baffle plate extends from the drive shaft housing in a second direction partially into said opening. The baffle plate overlaps a portion of said first plate in said opening to form a labyrinth structure, thereby impeding water flow.

The invention may further comprise a second plate extending from the lower bracket in said first direction partially into the opening. The second plate overlaps a portion of said baffle plate in said opening, and the combination of the first and second plate with the baffle plate forms a labyrinth structure.

The present invention may further comprise a splash plate formed on the lower bracket. The splash plate is formed about the front and sides of the lower bracket to obstruct the flow of water around the lower bracket.

The present invention may further comprise a splash rib formed on the lower bracket. The splash rib protrudes toward a lower unit of the outboard motor and limits the flow of water between the lower bracket and a lower unit.

Another embodiment of the present invention is a method of obstructing water flow through an opening beneath a cowling of an outboard motor. The method comprises the steps of projecting a first plate from a lower bracket in a first direction partially into the opening and then projecting a baffle plate from the drive shaft housing in a second direction partially into the opening. The baffle plate overlaps a portion of said first plate in the opening to form a labyrinth structure to impede the water flow. The invention may further comprise the step of projecting a second plate from the lower bracket in the first direction partially into said opening. The second plate overlaps a portion of the baffle plate in the opening to further form a labyrinth structure.

BRIEF DESCRIPTION OF THE DRAWINGS

These and other features of the invention will now be described with reference to the drawings of a preferred embodiment of the present marine propulsion system. The illustrated embodiment of the marine propulsion system is intended to illustrate, but not to limit the invention. The drawings contain the following figures.

DETAILED DESCRIPTION OF THE PREFERRED EMBODIMENT

Figure 1:
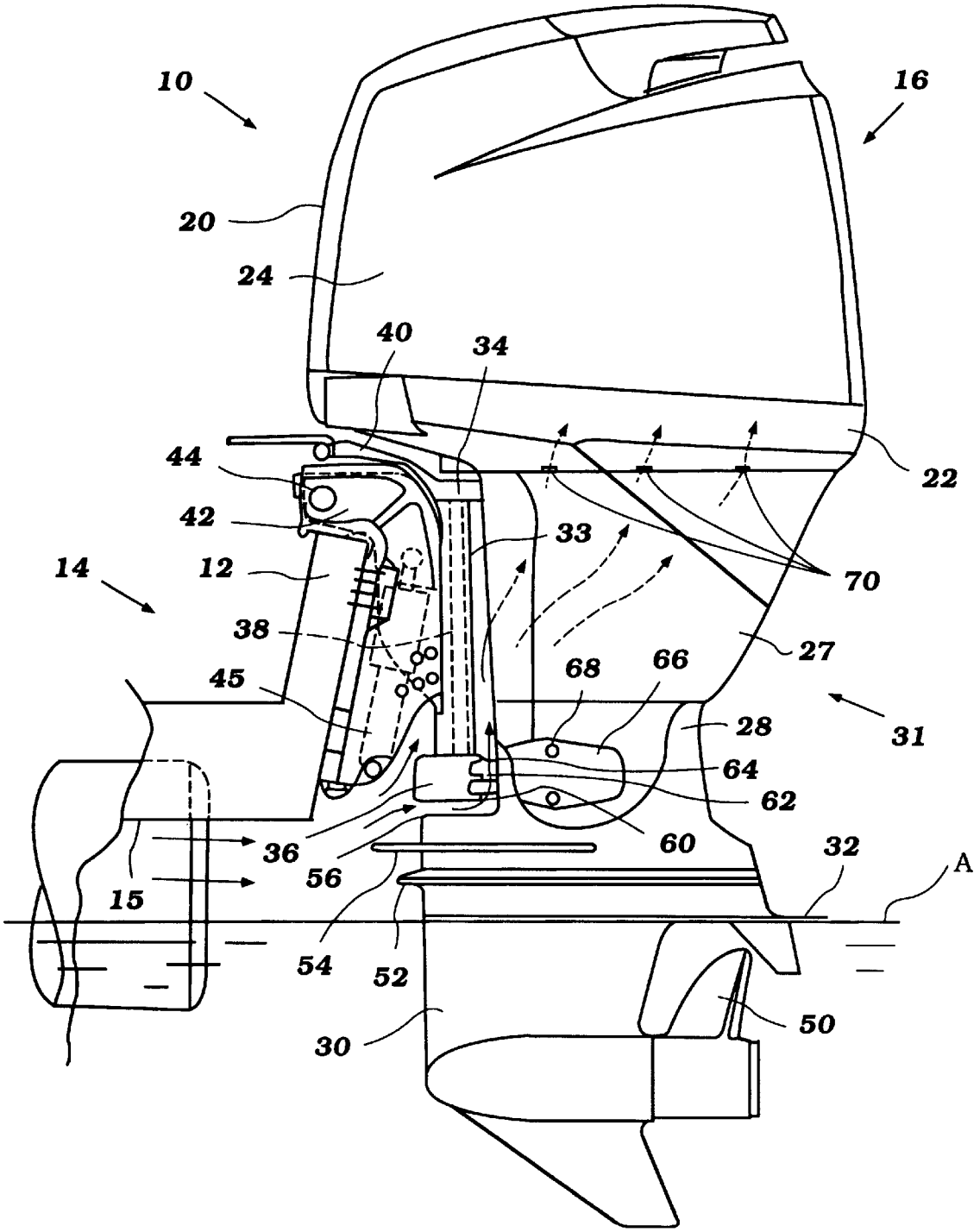
FIG. 1 is a side elevational view of an outboard motor which incorporates known splash and anti-cavitation.

FIG. 1 illustrates a marine drive configured as known in the prior art. In the illustrated embodiment, the marine drive is depicted as an outboard motor 10 for mounting on a transom 12 of the watercraft 14 having a bottom surface 15. It is contemplated, however, that those skilled in the art will readily appreciate that the present invention can be applied to stem drive units of inboard/outboard motors, and to other types of watercraft drive units, as well. Thus, as used herein, "outboard drive" generically means an outboard motor, an inboard/outboard motor including a stern drive, and similar marine drive units. Additionally, "front" and "rear" are used herein in reference to the transom 12 of the watercraft 14.

In the illustrated embodiment, the outboard motor 10 has a power head 16 which desirably includes an internal combustion engine (not shown). The internal combustion engine can have any number of cylinders and cylinder arrangements, and can operate on a variety of known combustion principles (e.g., on a two-stroke or a four-stroke principle).

A protective cowling assembly 20 surrounds the engine. The cowling assembly 20 includes a lower tray 22 and a top cowling 24. The lower tray 22 and the top cowling 24 together define a compartment which houses the engine with the lower tray 22 encircling a lower portion of the engine.

A drive shaft housing 28 extends downwardly from the lower tray 22 and terminates in a lower unit 30. A drive shaft (not shown) extends through the drive shaft housing 28 and is suitably journaled therein for rotation about the vertical axis. The drive shaft housing 28 and lower unit 30 collectively define a casing 31. An apron 27 covers a portion of the drive shaft housing 28. A plate 66 covers an opening in the drive shaft housing 28. The plate 66 is attached to the drive shaft housing 28 by bolts 68.

A conventional hydraulic tilt-and-trim cylinder assembly 45, as well as a conventional steering cylinder assembly, is used with the present outboard motor 10. The construction of the steering and trim mechanisms is considered to be conventional, and for that reason, further description is not believed necessary for an appreciation or understanding of the present invention.

A conventional steering shaft assembly 33 is affixed to the drive shaft housing 28 by upper and lower brackets 34, 36. The brackets 34, 36 support the steering shaft assembly 33 for steering movement. Steering movement occurs about a generally vertical steering axis which extends through a steering shaft 38 of the steering shaft assembly 33. A steering arm 40, which is connected to an upper end of the steering shaft 38, can extend in a forward direction for manual steering of the outboard motor 10, as known in the art.

The steering shaft assembly 33 also is pivotably connected to a clamping bracket 42 by a pin 44. This convention coupling permits the outboard motor 10 to be pivoted relative to the pin 44 to permit adjustment of the trim position of the outboard motor 10 and for tilt-up of the outboard motor 10.

A lower plate 60 and an upper plate 62 are located at a rear side of the lower bracket 36. The ends of the plates 60 and 62 are circularly concave, and a rectangular plate 64 is projected above them. The length of the plates 60–64 is such that a slight gap exists between the plates 60–64 and the drive shaft housing 28.

A lower splash plate 52 is located along the periphery between the drive shaft housing 28 and the lower unit 5. Furthermore, an upper splash plate 54 is located above the lower splash plate 52 and projects forward of the lower splash plate 52. A cavitation plate 32 extends outward in a substantially horizontal direction at the junction between the drive shaft housing 28 and the lower unit 30. The splash plates 52 and 54 and the cavitation plate 32 are arranged substantially in parallel to the bottom surface 15. The cavitation plate 32 controls any cavitations generated by the propeller 50, and thereby regulates water flow. When the boat is traveling, the splash plates 52 and 54 prevent the water hitting a front end of the lower unit 30 from splashing upwardly and further invading into the deeper part of the outboard motor 10.

The height of the transom 12 is adjustable by selecting one of the multiple bolt mount holes in the clamping bracket 42. When the outboard motor 10 is attached to the watercraft 14, the mounting height for the outboard motor 10 to the transom 12 can be adjusted so that the cavitation plate 32 is located in an extended line from the bottom surface 15. By mounting the outboard motor 10 in a position so the cavitation plate 32 is in line with the bottom surface 15, the splash plates 52 and 54 are thereby located above the water level to prevent water from splashing toward the upper part of the outboard motor 10 during the boat operation.

When the height of the transom 12 is properly adjusted, the level of the water relative to the watercraft 14 desirably lies along the line A when the watercraft 14 is either at rest (i.e., idling), accelerating from or decelerating to low speeds, as well as during low speed operation of the watercraft 14. The propeller 50 is thus entirely submerged beneath water during low speed operation and acceleration/deceleration of the watercraft 14. In this position, the cavitation plate 32 lies at the surface of the body of water in which the watercraft is operated.

However, this arrangement is not applicable for a pontoon boat in which a flat deck plate is placed on two drum-can-shaped pontoons (floats) and the outboard motor 10 is mounted in its stem. In this case, the splash plates 52 and 54 are likely below the water flowing between the bottom of the boat and water level when the pontoon boat is traveling. As a result, the splash plates 52 and 54 cannot regulate the splashing water to the upward direction.

In this circumstance, the splashing water hits near a level surface 56 and then flows to the upward and side directions along the drive shaft housing 28, as shown in arrows in FIG. 1.

Figure 2:
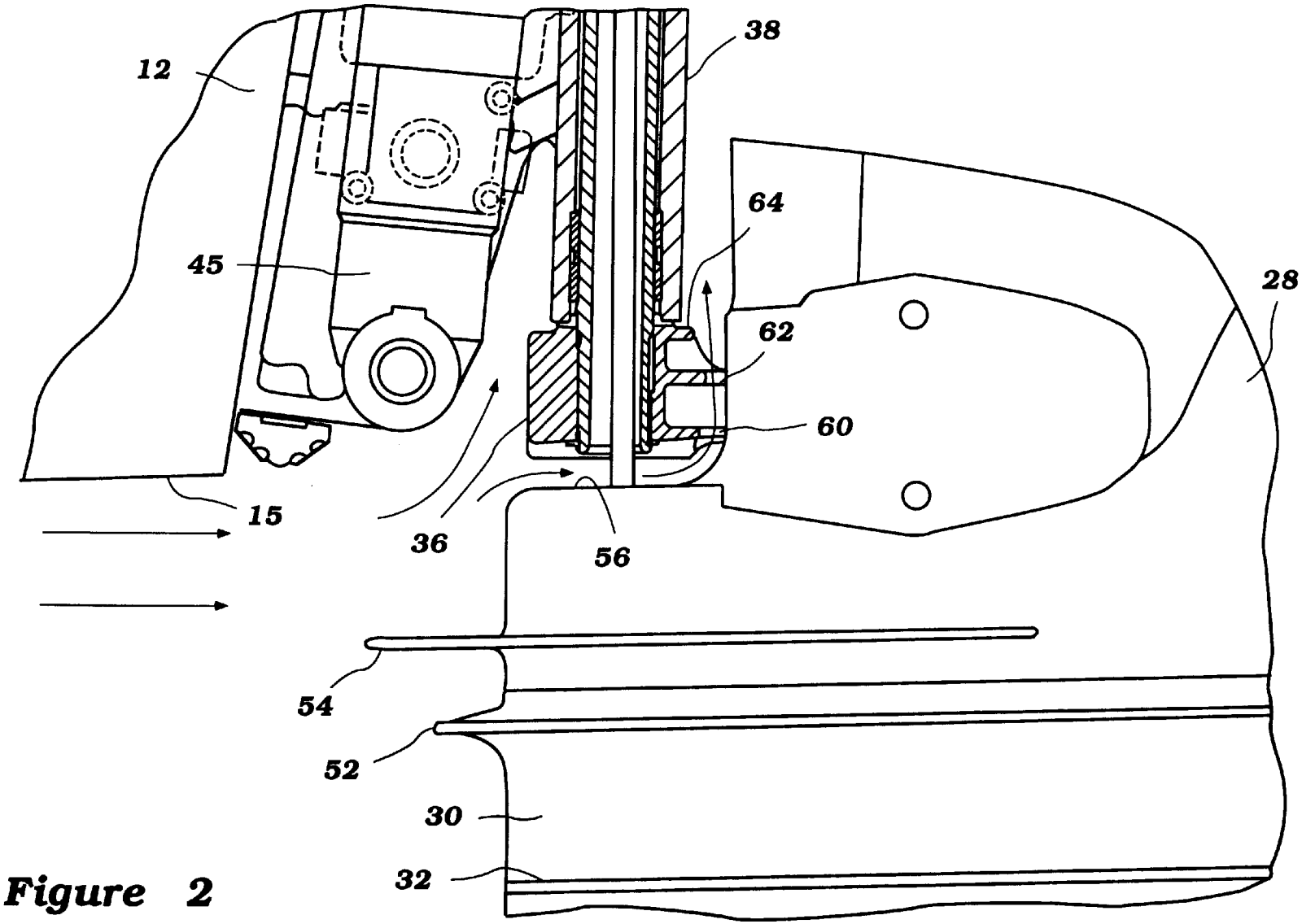
FIG. 2 is a detailed side elevational view of a portion of the outboard motor of FIG. 1.

FIG. 2 shows a detailed view of the water flow along the front side of the lower bracket 36 and upwardly along the steering shaft 38. The water passing between the lower bracket 36 and the level surface 56 may further pass through the gap at the rear of the plates 60 and 62 and front side of the drive shaft housing 28. This water may travel upwardly (see the arrows in FIGS. 1 and 2) until the water eventually reaches the bottom of the lower tray 22 through the inside of the apron 27.

Figure 3:
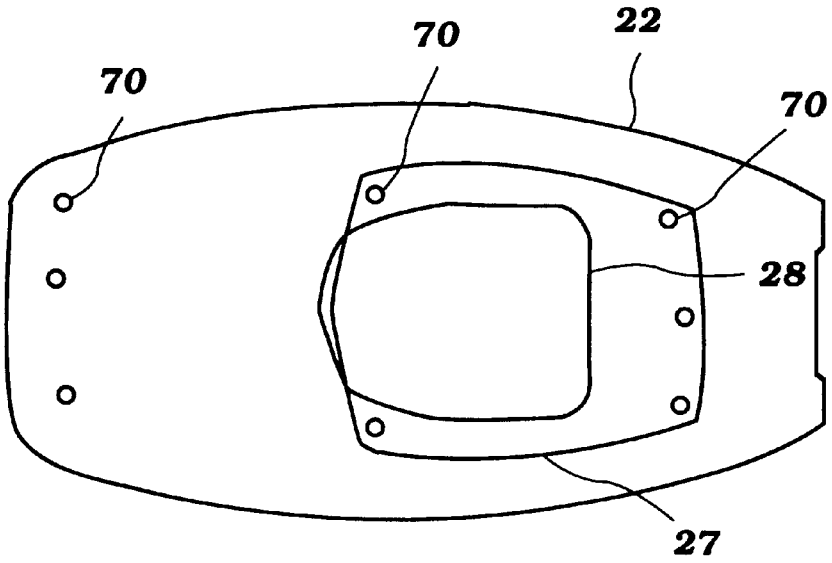
FIG. 3 is a bottom view of the outboard motor of FIG. 1.

As shown in FIGS. 1 and 3, there are plural drain holes 70 in the bottom of the lower tray 22 provided between the apron 27 and the drive shaft housing 28. Water entering the lower tray 22 through the drain holes 70 is likely to cause damage to the engine and its accessories that are stored inside the cowling assembly 20.

Figure 4:
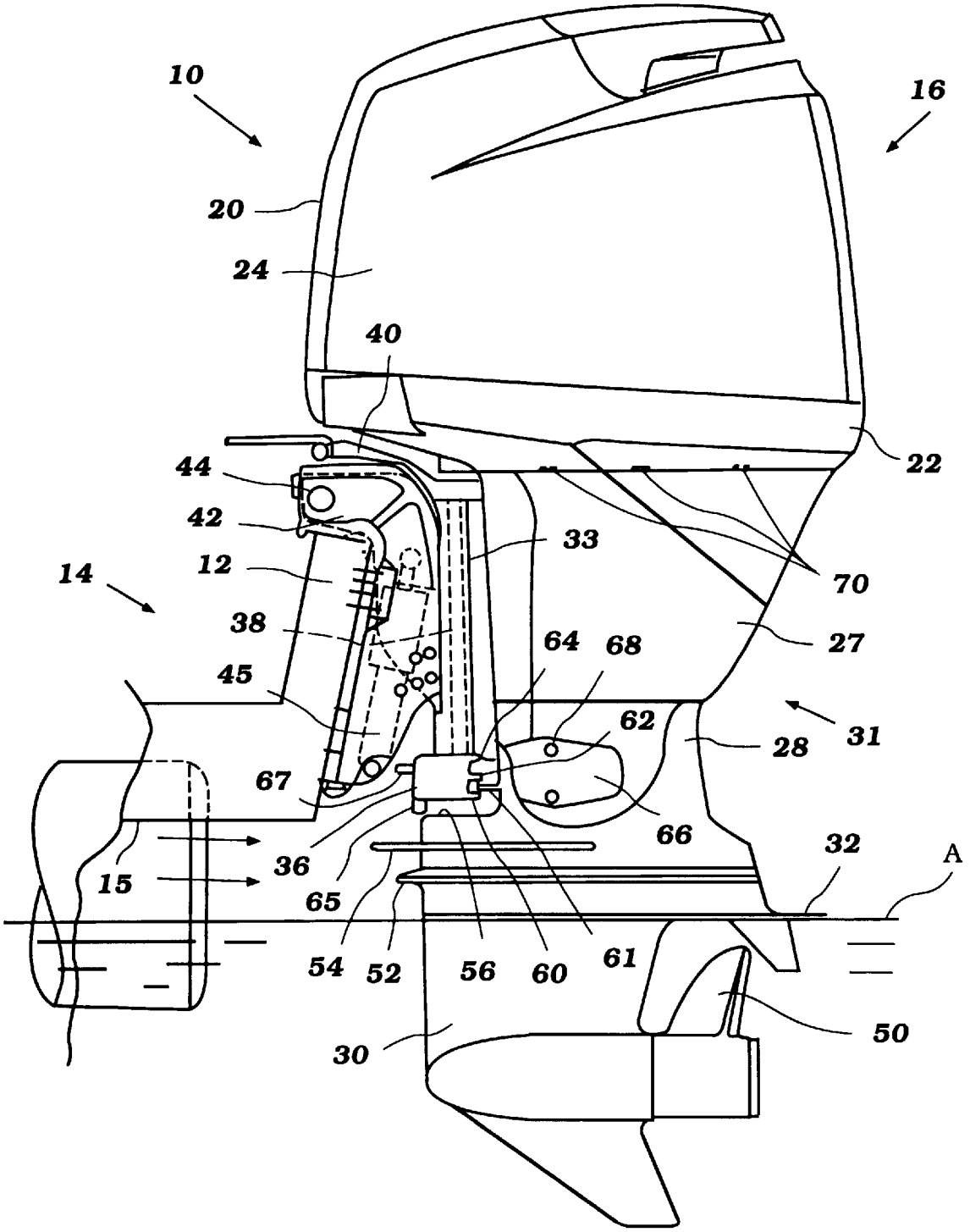
FIG. 4 is a side elevational view of an outboard motor which incorporates the water exclusion system according to the present invention.

An outboard motor 10 utilizing a water exclusion system according to the present invention is illustrated in FIG. 4. According to one embodiment of the invention, the lower bracket 36 includes a splash plate 67 to deflect any water traveling toward the front of the steering shaft 38. The splash plate 67 protrudes from the lower bracket 36 and is generally parallel with the splash plates 52 and 54. The splash plate 67 not only deflects water away from the steering shaft 38, but also decreases the size of the gap between the lower bracket 36 and the housing for the cylinder assembly 45. Decreasing the size of this gap reduces the volume of water capable of reaching the drive shaft housing 28.

The lower bracket 36 also includes a splash rib 65 extending in a direction approximately perpendicular from the splash plate 67. The splash rib 65 extends from the lower bracket 36 toward the level surface 56. The splash rib 65 provides an obstruction to block water from flowing through the gap created between the lower bracket 36 and the level surface 56. Decreasing the size of this gap reduces the volume of water capable of flowing along the level surface 56 and reaching the drive shaft housing 28.

Although the splash rib 65 decreases the amount of water flowing between the lower bracket 36 and the level surface 56, it is possible some water may flow past the splash rib 65. Therefore, a baffle plate 61 extends from the drive shaft housing 28 and interacts with the upper plate 62 and the lower plate 60 to create a labyrinth structure. Of course, although the baffle plate 61 is shown interacting with both the upper plate 62 and the lower plate 60, the labyrinth structure may be created using only one of the plates 60 and 62.

Figure 5:
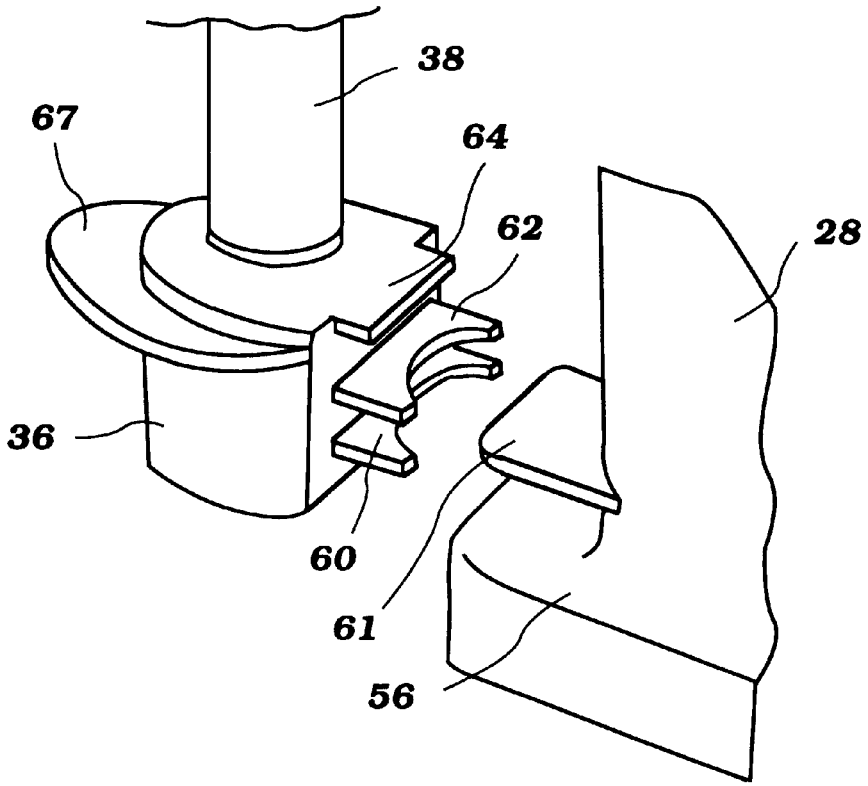
FIG. 5 is an exploded side elevational view of the water exclusion system according to the present invention.

FIG. 5 shows a detailed view of the lower bracket 36 according to one embodiment on the invention. As can be appreciated, the splash plate 67 extends forward and partially to the sides of the lower bracket 36. The splash plate 67 deflects water travelling in an upward direction along the front and sides of the lower bracket 36. As described above, the ends of the upper and lower brackets 60 and 62 are concave and of a semi-circular shape. This shape allows the upper and lower brackets 60 and 62 to conform with the drive shaft housing 28 while the steering shaft 38 is turned. As illustrated in FIG. 4, the upper and lower brackets 60 and 62 extend only partially into the opening between the steering shaft 38 and the drive shaft housing 28. The rectangular plate 64 is shorter than the upper and lower brackets 60 and 62 to prevent interference with the drive shaft housing 28.

FIG. 5 also shows a detailed view of the baffle plate 61 according to the present invention. The baffle plate 61 extends from the drive shaft housing 28 partially into the opening between the steering shaft 38 and the drive shaft housing 28. The baffle plate 61 is positioned between the upper plate 62 and the lower plate 60. The length of the baffle plate 61 is such that the edge of the baffle plate 61 overlaps the edges of the upper and lower plates 60 and 62. The baffle plate may be integrally formed in the drive shaft housing 28 or may be a removable component.

Figure 6:
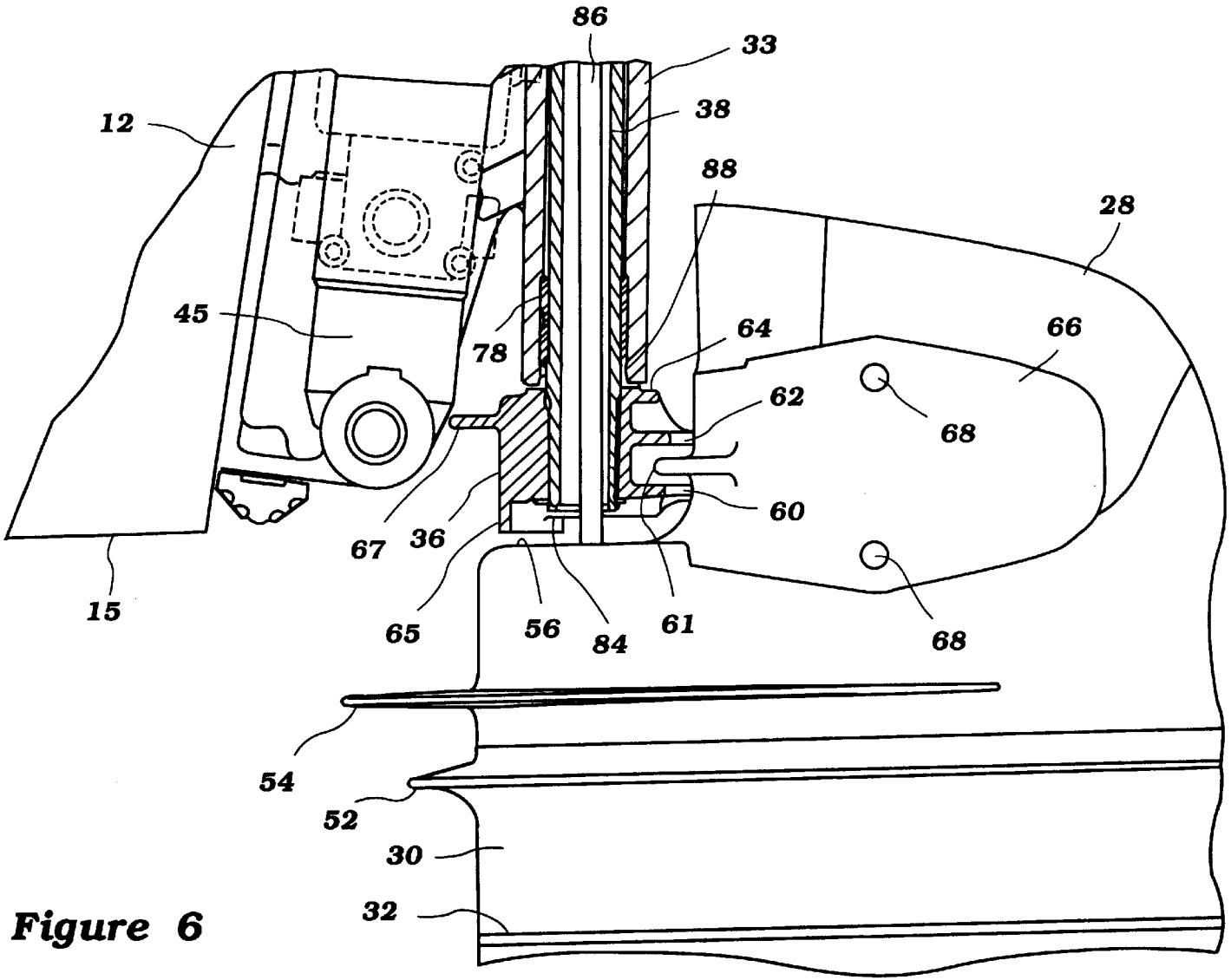
FIG. 6 is a detailed side elevational view of a portion of the outboard motor of FIG. 4.

FIG. 6 illustrates the labyrinth structure created by the interaction of the baffle plate 61 with the upper and lower plates 60 and 62. As can be appreciated, any water that flows through the gap between the lower bracket 36 and the level surface 56 first encounters the lower plate 60. To bypass the lower plate 36, water must flow around the edge of the lower plate 36. Because the baffle plate 61 overlaps the edge of the lower plate 36, this water now impacts the bottom surface of the baffle plate 61. For the water to move past the baffle plate 61, the flow of the water must change 180 degrees and move toward the lower bracket 36. When reaching the lower bracket 36, the upper plate 62 forces the flow of the water to again change 180 degrees and move back toward the drive shaft housing 28. Because the labyrinth structure created by the interaction of the upper and lower plates 60 and 62 and the baffle plate 61 force such substantial change in water flow, the amount of water capable of passing through the labyrinth structure is minimized. This decreases the amount of water eventually reaching the cowling assembly 20.

Figure 7:
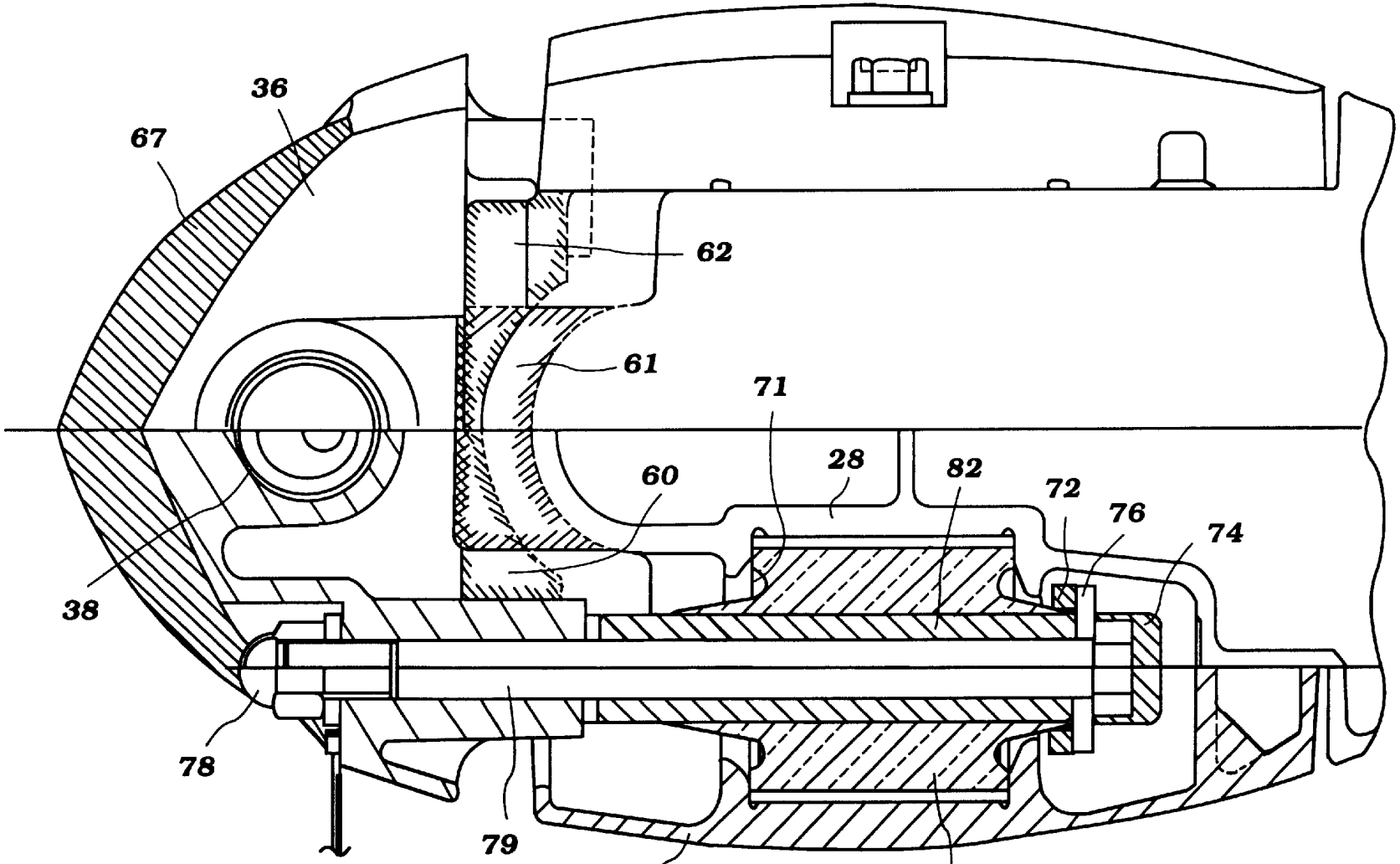
FIG. 7 is a cut-away bottom view illustrating the attachment of the lower bracket to the outboard motor of FIG. 4.

Attachment of the lower bracket 36 to the drive shaft housing 28 is shown in FIGS. 6 and 7. A shift shaft 86 extends through the steering shaft 38 and into the lower unit 30. The shift shaft 86 is secured to the lower bracket 36 via a C-clip 84. A bolt 79 is inserted through the lower bracket 36 and into the drive shaft housing 28. A cap nut 78 is placed on the end of the bolt 79 protruding from the lower bracket 36. To access the end of the bolt 79 in the drive shaft housing 28, the plate 66 is removed. A washer 76 helps hold the bolt 79 in position. Rubber dampers 72 and 74 are placed on the end of the bolt to absorb shocks and dampen any movement of the bolt caused by vibrations of the engine. A rubber sleeve 82 is provided along the length of the bolt 79, and the rubber sleeve 82 is further secured by a rubber collar 80. The combination of the rubber sleeve 82 and the rubber collar 80 provide dampening along the length of the bolt. A collar 71 is used to hold the entire rubber sleeve 82 and rubber collar 80 combination together. The collar 71 is separated from the lower bracket 36 by an 0-ring 88.

Numerous variations and modifications of the invention will become readily apparent to those skilled in the art. Accordingly, the invention may be embodied in other specific forms without departing from its spirit or essential characteristics. The detailed embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. A water exclusion system for an outboard motor comprising a first plate and a baffle plate, wherein said first plate extends from a lower bracket in a first direction partially into an opening between said lower bracket and a drive shaft housing, and said baffle plate extends from said drive shaft housing in a second direction partially into said opening, Wherein said baffle plate overlaps a portion of said first plate in said opening to form a labyrinth structure, thereby impeding water flow between said lower bracket and said drive shaft housing.

2. The water exclusion system of claim 1, wherein said baffle plate is integrally formed in said drive shaft housing of said outboard motor.

3. The water exclusion system of claim 1, further comprising a second plate extending from said lower bracket in said first direction partially into said opening, wherein said second plate overlaps a portion of said baffle plate in said opening.

4. The water exclusion system of claim 3, wherein the baffle plate is positioned between said first plate and said second plate.

5. The water exclusion system of claim 1, wherein said first plate is integrally formed in said lower bracket of said outboard motor.

6. The water exclusion system of claim 5, wherein said lower bracket further comprises a splash rib, wherein said splash rib protrudes toward a lower unit of the outboard motor.

7. The water exclusion system of claim 6, wherein said splash rib limits the flow of water between said lower bracket and said lower unit.

8. The water exclusion system of claim 5, wherein said lower bracket further comprises a splash plate.

9. The water exclusion system of claim 8, wherein said splash plate is positioned about a front and sides of the lower bracket to obstruct the flow of water around the lower bracket.

10. A method of obstructing water flow through an opening beneath a cowling of an outboard motor, the method comprising the steps of projecting a first plate from a lower bracket in a first direction partially into said opening; and projecting a baffle plate from said drive shaft housing in a second direction partially into said opening, wherein the baffle plate overlaps a portion of said first plate in said opening.

11. The method of claim 10, further comprising the step of projecting a second plate from said lower bracket in said first direction partially into said opening, wherein said second plate overlaps a portion of said baffle plate in said opening.

12. The method of claim 11, wherein said baffle plate, said first plate, and said second plate form a labyrinth structure in said opening.

* * * * *

UNITED STATES PATENT AND TRADEMARK OFFICE

CERTIFICATE OF CORRECTION

PATENT NO. : 6,048,236
DATED : April 11, 2000
INVENTOR(S) : Noriyuki Natsume

It is certified that error appears in the above-identified patent and that said Letters Patent is hereby corrected as shown below:

Title page,
Item [56], References Cited, U.S. PATENT DOCUMENTS, please add:
-- 2,442,728 6/1948 Kiekhaefer 440/78 --
-- 2,860,594 11/1958 Kiekhaefer 440/78 --

Signed and Sealed this

Eighth Day of October, 2002

*Attest:*

*Attesting Officer*

JAMES E. ROGAN
*Director of the United States Patent and Trademark Office*